US008303100B2

(12) United States Patent
Schierholz et al.

(10) Patent No.: US 8,303,100 B2
(45) Date of Patent: Nov. 6, 2012

(54) METHOD AND APPARATUS FOR PRINTING OBJECTS, IN PARTICULAR PLASTIC PARTS

(75) Inventors: Albrecht Schierholz, Schieder-Schwalenberg (DE); Dieter Stellmach, Bad Duerrheim (DE); Wilfried Rohde, Unterkimach (DE)

(73) Assignee: Phoenix Contact GmbH & Co. KG, Blomberg (DE)

( * ) Notice: Subject to any disclaimer, the term of this patent is extended or adjusted under 35 U.S.C. 154(b) by 1134 days.

(21) Appl. No.: 12/161,673

(22) PCT Filed: Jan. 9, 2007

(86) PCT No.: PCT/EP2007/000109

§ 371 (c)(1),
(2), (4) Date: Jul. 21, 2008

(87) PCT Pub. No.: WO2007/087957

PCT Pub. Date: Aug. 9, 2007

(65) Prior Publication Data

US 2010/0220162 A1 Sep. 2, 2010

(30) Foreign Application Priority Data

Jan. 20, 2006 (DE) ..... 10 2006 003 056

(51) Int. Cl.
*B41J 2/01* (2006.01)

(52) U.S. Cl. ..... 347/102

(58) Field of Classification Search ..... None
See application file for complete search history.

(56) References Cited

U.S. PATENT DOCUMENTS

| | | | | |
|---|---|---|---|---|
| 4,771,295 | A | 9/1988 | Baker et al. | |
| 6,344,869 | B2 * | 2/2002 | Sasaki et al. | 347/222 |
| 6,655,798 | B2 | 12/2003 | Temple et al. | |
| 6,715,870 | B2 | 4/2004 | Kiene et al. | |
| 7,232,212 | B2 * | 6/2007 | Iwase | 347/102 |
| 2002/0024544 | A1 | 2/2002 | Codos | |
| 2002/0125166 | A1 | 9/2002 | Laudat | |
| 2005/0168518 | A1 * | 8/2005 | Nishino | 347/29 |
| 2006/0132554 | A1 * | 6/2006 | Ota et al. | 347/85 |

FOREIGN PATENT DOCUMENTS

| | | | |
|---|---|---|---|
| CN | 2472928 | Y | 1/2002 |
| CN | 1374234 | A | 10/2002 |
| CN | 1377784 | A | 11/2002 |

(Continued)

*Primary Examiner* — Matthew Luu
*Assistant Examiner* — Renee I Wilson
(74) *Attorney, Agent, or Firm* — Leydig, Voit & Mayer, Ltd.

(57) ABSTRACT

A method for imprinting objects, including providing a printing machine configured to deliver at least one object to be imprinted to a printing apparatus using a retaining apparatus or an inscription carrier. A data processing system is provided and includes at least one print pattern stored in at least one database. The data processing system is connected to the printing machine and configured to control the printing machine. A liquid is applied so as to generate the at least one print pattern on a surface of the at least one object using the printing apparatus. The at least one object is then exposed to a radiation so as to dry and cure the liquid and then the retaining apparatus or the inscription carrier is conveyed to an output station. The retaining apparatus and inscription carrier are stackable in the output station.

10 Claims, 4 Drawing Sheets

FOREIGN PATENT DOCUMENTS

| | | | |
|---|---|---|---|
| CN | 1666940 | A | 9/2005 |
| DE | 4342643 | | 3/1995 |
| DE | 19823195 | | 11/1999 |
| DE | 19916219 | | 10/2000 |
| DE | 19923291 | | 11/2000 |
| DE | 20022158 | | 3/2001 |
| DE | 10115065 | | 10/2002 |
| DE | 69909322 | | 5/2004 |
| DE | 102004058084 | | 7/2005 |
| EP | 0419442 | | 3/1991 |
| EP | 0619849 | | 10/1994 |
| EP | 0714775 | | 6/1996 |
| EP | 0991063 | | 4/2000 |
| EP | 1468834 | | 10/2004 |
| GB | 2235163 | | 2/1991 |
| WO | 00/30856 | A1 | 6/2000 |

* cited by examiner

METHOD AND APPARATUS FOR PRINTING OBJECTS, IN PARTICULAR PLASTIC PARTS

CROSS REFERENCE TO PRIOR APPLICATIONS

This application is a U.S. National Phase application under 35 U.S.C. §371 of International Application No. PCT/EP2007/000109, filed on Jan. 9, 2007 and claims benefit to German Patent Application No. DE 10 2006 003 056.7, filed on Jan. 20, 2006. The International Application was published in German on Aug. 9, 2007 as WO 2007/087957 under PCT Article 21 (2).

FIELD

The present invention refers in general to the field of imprinting objects, and relates in particular to a method for imprinting objects. A further aspect of the present invention is an apparatus for imprinting objects.

BACKGROUND

Imprintable objects can be made from various materials, for example plastic, ceramic, glass, wood, metal.

The imprinting of plastic parts, or of their surfaces, can be accomplished by the application of a variety of printing technologies. Known methods are the conventional printing methods such as, for example, the offset, pad, or silk screen methods.

Printing machines, in particular inkjet printers, are known for the printing of individual print patterns, especially for smaller part volumes. Inkjet printers are characterized by the selective application of liquid, in particular a jet of ink, onto a recording material, the inkjet printer being a matrix printer in which, by the targeted ejection or deflection of small ink droplets, a print pattern is generated on a surface; conventional inkjet printers are not suitable for imprinting plastic parts.

The plastic parts are, for example, electronics housings or housing covers for interface technologies, and labels, so-called self-adhesive or clip-in identification strips, identification cards, cable ties, slide-in signs, signage panels, terminal strip identifiers, designation sleeves, or other shaped parts for the identification or marking of, for example, modular terminal blocks, printed terminal blocks of all types, and converters, to name only a few.

The labels or signs are detachable secured, depending on their shape, on a variety of inscription carriers, labels or signs of film-like configuration being detachably adhered onto ribbon-shaped inscription carriers. Plastic signs or labels in particularly configured shapes are arranged in retaining apparatuses, in particular in frame-like inscription carriers, and attached thereto, for example, with defined break points. The retaining apparatuses thus contain shaped parts that, because of their conformation, are unsuitable or too small to be separately inscribed in a printer. They are therefore joined to a carrier element, the carrier element having a format that can be conveyed by the printer or the transport device.

The existing art describes the imprinting of objects, in particular of plastic parts, by silk screen and pad printing. EP 0 991 063 B1, in which the imprinting of optical data media with UV-curable ink is described, may be recited here as a representative of many examples. The disadvantage is that these printing methods are suitable only for the imprinting of print patterns that are always the same, and not for the objects previously mentioned. The aforesaid printing methods all operating with special printing tools that are not only complex and expensive, but also inflexible as regards adaptation of a print pattern to different predefined print patterns.

Pen plotters are also known from the existing art. A pen plotter is designed for print patterns on paper, generally DIN A3 to A0. In special cases, detachable labels adhesively bonded onto flat inscription carriers can also be imprinted. The pen plotter uses for this purpose an ink pen that is mounted on a carriage. The carriage slides along a bar that either can be displaced over the entire width of the paper, or is installed fixedly. The disadvantage of pen plotters is that they are slow when imprinting objects, and cumbersome to handle. The solvent-containing ink that is used additionally results in disruptions in the inscribing process, for example because pens have dried out. Pen plotters are therefore seldom used in the commercial sector.

GB 2235 163 A describes a plotter for imprinting plastic cassettes, in which plotter imprinting is accomplished by way of a thermal method with a heatable plotter pen and a carbon ribbon. The disadvantage here is that this method can be applied only to plastic, and furthermore that only a low resolution and printing speed can be implemented. The low printing speed results from the fact that the plotter pen must travel to each letter individually, in the manner of a plotter.

Printing machines that adapt commercially available inkjet printers are also known. These inkjet printers utilize water-based ink. With this printing method, the inscription carrier is heated, after the printing operation is complete, so greatly that the aqueous component of the ink is evaporated. EP 0 619 849 B1 describes an inkjet recording device that is equipped with a combined heating apparatus and blower unit for drying the printed-on ink with hot air. A disadvantage is that the inscription carriers must be heated to a temperature above 100 degrees Celsius in order for the water component contained in the ink to evaporate. The inscription materials are very highly stressed by the heat, and can distort or change shape. The adhesion of aqueous inks onto plastic surfaces is also insufficient. In order to protect the objects from excessive heating during imprinting, DE 43 42 643 C2 describes a method that fixes the printed-on ink with a low-heating radiation, the ink being fixed by a photochemical reaction. Fixing is accomplished by the use of a UV radiation source, eliminating the print-delaying waiting phase with thermal fixing. A UV radiation source downstream from the printing process is used for this purpose. There is a physically close association between the ink application unit and the UV radiation source: this has a disadvantageous effect on the ink application unit because of the heat generated by the UV radiation source. The heat that is generated acts unimpededly in all directions, and it is not possible to imprint various objects with this inkjet printer.

To prevent unimpeded propagation of the heat that results from radiation sources, DE 200 22 158 U1 describes a drying unit that is usable with an infrared radiation source. This involves a separate drying unit, equipped with a passive cooling agent, that is placed downstream from inkjet printers. The disadvantage of this drying unit is that it is usable only as a standalone unit for sheet paper drying, at a distance of approximately 20 to 30 cm from the inkjet printer. The drying of other imprinted objects is not possible.

In a further embodiment, DE 198 23 195 C2 describes a method and an apparatus for imprinting plastic workpiece surfaces. The method and apparatus are specifically designed only for the imprinting of profiled strips, the latter's surface being pretreated with a plasma process for better adhesion of the ink. Treatment of the surface with UV radiation for faster drying and curing of the ink does not occur. The inkjet printer is also not suitable for imprinting the objects mentioned above.

DE 101 15 065 describes a method and an apparatus for imprinting cassettes or specimen slides for histological preparations and/or glass specimen slides for microscopic thin sections, in which a computer device is provided for controlling the printing device, and the printing device comprises an inkjet printer for imprinting the cassettes and/or specimen slides. The ink is predried via a hot-air drying system, and completely dried via a flash device. The processing speed in the printing device is, however, greatly limited by the hot-air drying system. The hot-air and flash device is not integrated into inkjet printers. The inkjet printer used in the printing device is moreover a conventional inkjet printer that is equipped with a stationary ink tank on the printer frame to supply the print head. Examples of stationary ink tanks are described in the documents DE 199 23 291 B4 and DE 199 16 219 C2. Stationary ink tanks have the disadvantage that they are equipped with complex individual technical parts in order to generate a negative pressure in the print head or at the nozzle device. Such embodiments of ink tanks are too complicated in terms of their design and construction, and thus too expensive to manufacture.

A further problem with achieving a high-contrast printed image is that of ensuring a negative pressure of a few millibars that is present at the nozzle device of the printing apparatus. As known from the existing art, the negative pressure can be ensured by an ink tank equipped with an ink absorber. An ink tank of this kind is described in U.S. Pat. No. 4,771,295, such embodiments of ink tanks being arranged physically above the nozzle device in the printing machine. The absorber used in the ink tanks, which is manufactured in a complex process, possesses an essential disadvantage. The absorber is made up of a foam block that has only limited resistance with respect to solvent-containing ink. Because the objects to be imprinted are made of various materials, however, only solvent-containing inks are suitable for the printing method.

In order to mark plastic materials it is therefore necessary to use printing ink that, when printed, is particularly effective on a wide selection of plastic materials by way of an inkjet printer as described in EP 0 419 442 B1, these inks possessing a defined curing, fixing, or hardening phase that becomes effective upon exposure of the ink to UV radiation. When UV-curable inks of this kind, as described in DE 69909 3322 T2, are used, it is necessary, in order to avoid printing defects, to equip the inkjet printer with an ink removal apparatus, as described in DE 10 2004 058 084 A1, that removes the residual ink from an inkjet printing head. The ink removal apparatuses known from the existing art encompass only wiping elements that skim over the nozzles of the inkjet printing head. An optimized ink removal configuration, which also enables cleaning of the nozzle device by means of a pump, is therefore required.

SUMMARY

An aspect of the present invention is to provide a method and an apparatus for imprinting objects that address the aforesaid disadvantages of the known arrangements, and to enable objects made of various materials, in particular plastic parts, to be imprinted. Because of the variety of different objects to be imprinted with rapidly changing print patterns, they should be inscribed in a largely thermally low-impact manner with a high-contrast printed image, and a high throughput per unit time of retaining apparatuses or inscription carriers should be achieved; delivery of the retaining apparatuses or inscription carriers of a print job from the supply stack in the printing machine to the printing apparatus, and from there to collected discharge in the printing machine after imprinting of the objects or their surfaces, is to occur automatically on a straight-line path.

In an embodiment, the present invention provides a method for imprinting objects, including providing a printing machine configured to deliver at least one object to be imprinted to a printing apparatus using a retaining apparatus or an inscription carrier. A data processing system is provided and includes at least one print pattern stored in at least one database. The data processing system is connected to the printing machine and configured to control the printing machine. A liquid is applied so as to generate the at least one print pattern on a surface of the at least one object using the printing apparatus. The at least one object is exposed to a radiation after the applying step so as to dry and cure the liquid and then the retaining apparatus or the inscription carrier is conveyed to an output station. The retaining apparatus and inscription carrier are stackable in the output station. The at least one print pattern is predefined using the data processing system.

In another embodiment, the present invention provides an apparatus for imprinting objects and having a printing machine, the printing machine including a transport apparatus configured to transport a retaining apparatus or an inscription carrier. A printing apparatus is configured to imprint a print pattern on at least one object using a jet of liquid. A radiation source is configured to dry and cure the print pattern. A replaceable liquid container is configured to supply the printing apparatus with a liquid. A replaceable cleaning apparatus is configured to clean a nozzle device of the printing apparatus. An input station and an output station are configured to receive the retaining apparatus or the inscription carrier. A carriage is configured to receive the printing apparatus, the radiation source, and the liquid container, the carriage being movable back and forth. A data processing system is configured to control the printing machine.

BRIEF DESCRIPTION OF THE DRAWINGS

An exemplifying embodiment of the invention is depicted schematically in the drawings, and will be described in further detail below. In the drawings.

DETAILED DESCRIPTION

Figure 1:
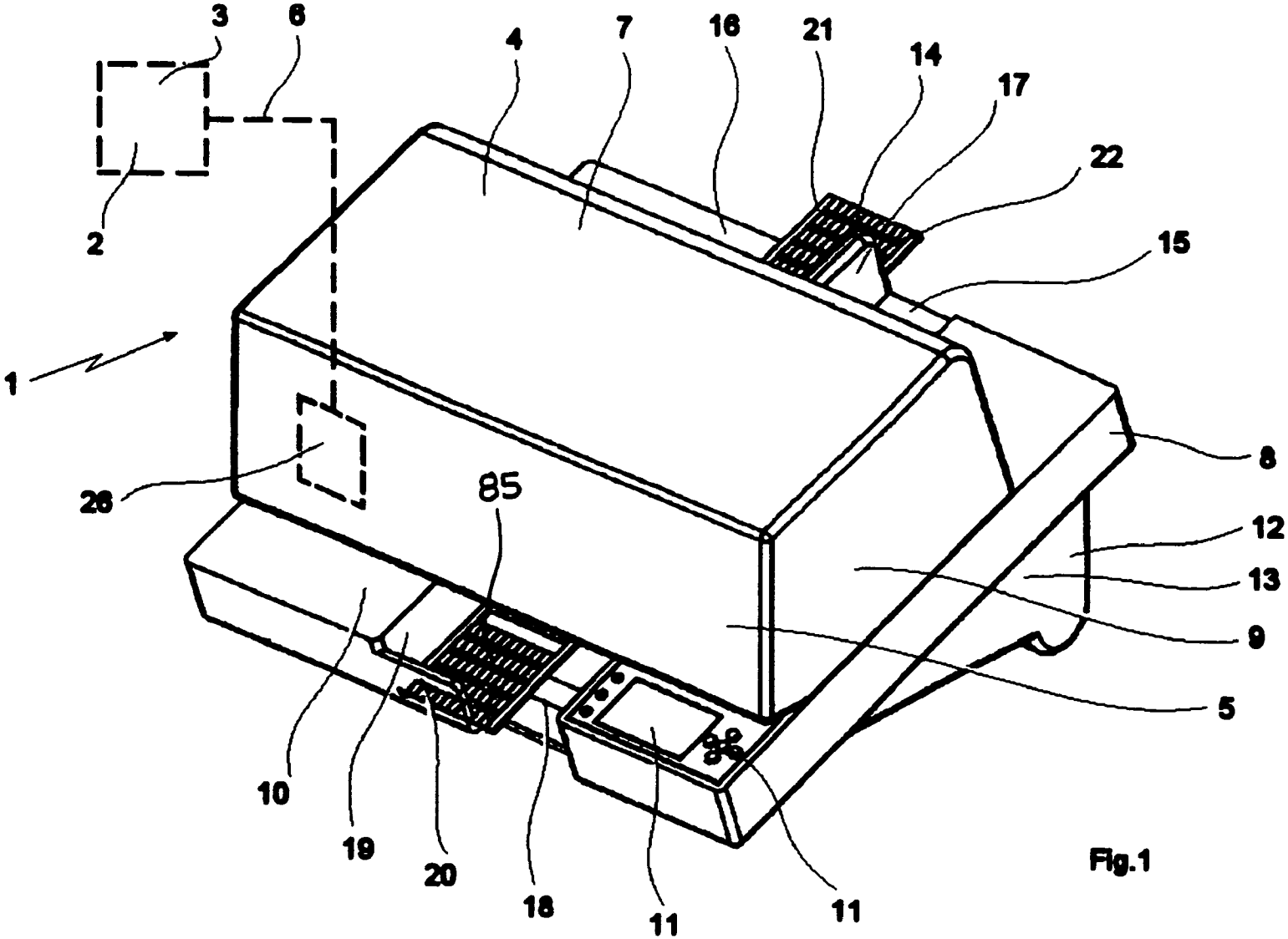
FIG. 1 is a perspective view of the apparatus according to the present invention.

In order to obtain a method, equipped with these features of the present invention, for imprinting objects of different sizes and different materials, in particular plastic parts for interface technology and products thereof on retaining apparatuses, and/or for imprinting signs, labels, etc. on inscription carriers, it is provided according to the present invention to make available a data processing system that on the one hand contains a plurality of print patterns stored in databases in order to meet the need for print patterns requiring rapid changing, and to make available a printing apparatus with which flexible changing of the print pattern is allowed even during printing operation, and which on the other hand is suitable for controlling the printing machine. In the second method step, a printing machine is made available that is connected via interfaces to the data processing system. In the context of the printing machine, the objects or plastic parts to be imprinted are placed, with the aid of a retaining apparatus or with a inscription carrier, into the insertion tray of the input station, and conveyed to the printing apparatus with a transport device. Once the objects are in the printing position of the printing machine, those surfaces of the objects that are to be printed are inscribed by means of the computer-controlled printing apparatus with at least one of the print patterns predefined by the data processing system. In a further method step, after the printing operation or after the application of one or more print patterns, the objects are illuminated by a radiation source that is arranged next to the printing apparatus on the same carriage and is controlled by the data processing system. In other words, the objects are exposed to a radiation by means of which the liquid applied by the printing apparatus is dried and cured without appreciably heating the objects, the retaining apparatus, or the inscription carrier. An advantageous effect is achieved by way of a tuned wavelength of the radiation of the radiation source, which abruptly heats the liquid constituents of the liquid and evaporates then in fractions of a second. After complete drying and curing of the applied liquid, the retaining apparatus or inscription carrier is conveyed with the aid of the transport device to the output tray of the output station, the retaining apparatuses and inscription carriers being stackable in the output tray of the output station. In a further embodiment of the invention, the data processing system can comprise a computer and the printing machine can comprise an inkjet printer, such that the print patterns can be formed by an inkjet printer and are UV-curable.

The apparatus according to the present invention for imprinting objects, in particular plastics, includes, a data processing system for controlling a printing machine. The printing machine includes a transport apparatus for transporting the retaining apparatus or the inscription carriers; a printing apparatus for imprinting the objects, in particular plastic parts; a radiation source for drying and curing the print pattern generated by a jet of liquid; a replaceable liquid container for supplying the printing apparatus with liquid; a replaceable cleaning apparatus for cleaning the nozzle device; and an input and output station for the retaining apparatus or the inscription carriers; the printing apparatus, the radiation source, and the liquid container are arranged, according to the present invention, on a common carriage that is movable back and forth.

The carriage is mounted on various crossmembers that are joined to the printer frame inside the housing. The housing of the printing machine is configured such that the input station for receiving the retaining apparatus or the inscription carriers is arranged in elevated fashion with respect to the output station, producing between the input and the output station an inclined plane that also forms the printing plane or is parallel to the printing plane. The inclined plane is formed by the supports belonging to the housing, the supports having a shape that corresponds to a wedge. As a result of the wedge shape of the supports, the printing machine assumes a position tilted with respect to the horizontal plane, so that the printing plane is also located on an inclined plane. The input and output stations are located at the ends of the inclined plane, the input station being arranged at the highest point and the output station at the lowest point. The printing apparatus is arranged approximately halfway between the input and output station. The printing apparatus sits perpendicular to the printing plane, and the liquid container for supplying the printing apparatus with liquid is located downslope behind the printing apparatus toward the output station. The printing apparatus and the liquid container are at a short distance from the inclined printing plane, and are arranged with respect to one another in such a way that the liquid container, with its liquid level, is in a lowered position with respect to the nozzle device of the printing apparatus, so that the liquid level in the liquid container generates a negative pressure in the nozzle device of the printing apparatus via the principle of communicating tubes.

The liquid container is detachably connected on the entrance side, with interposition of a valve, to a device, in particular an air compressor, for generating a positive pressure in the liquid container, and on the exit side to the printing apparatus, with the result that the liquid container becomes interchangeable and thus yields an easily replaceable tank. The detachable connection on the exit side to the liquid container comprises a supply line that is coupled on the input side to the printing apparatus. The printing apparatus possesses an outlet opening on the exit side; a measuring apparatus, in particular a liquid level sensor, whose exit or exit opening can be selectably opened or closed by way of an attached valve, is connected directly to the outlet opening. The function of the liquid supply unit is described in further detail in FIG. 2.

The invention for imprinting objects is further notable for the aspect that after the objects are imprinted, the printing apparatus travels to the parked position, located in the linewise direction, at which a cleaning station is located. On the way to the parked position, the nozzle device of the printing apparatus skims over a wiping device, in particular a wiper blade, of the cleaning apparatus, which contains a storage space for absorbing the liquid wiped off from the nozzle device. Once the printing apparatus is in the parked position of the cleaning station, the nozzle device is located opposite the funnel opening contained in the cleaning apparatus, the cleaning apparatus of the cleaning station being arranged below the inclined printing plane and encompassing a replaceable cleaning container. The cleaning container serves on the one hand to receive the liquid residues that occur upon removal from the nozzle device, and on the other hand to receive the liquid resulting from the nozzle device cleaning operation. The cleaning apparatus therefore contains a replaceable cleaning container having an opening for receiving the liquid, having a storage space for the liquid, having a wiping device, and having at least one opening next to the wiping device. The cleaning operation is explained further in FIG. 2.

The printing machine is also notable, according to the present invention, for the aspect that in addition to the printing apparatus present on the carriage, a radiation source is provided that irradiates the print pattern applied onto the objects, after the printing operation, with radiation, in particular light; for drying and curing, the light contains a wavelength that is tuned to the liquid and that cures the liquid print patterns without greatly warming or heating the objects. According to the present invention, greater heating of the objects by the elements downstream from the radiation source may be eliminated or greatly reduced. For that purpose, when the printing apparatus is in the parked position, the radiation emergence side of the radiation source is located above the inclined printing planes at a defined distance from the surface of the objects to be irradiated; and a shaft, in particular a light shaft, is located below the inclined printing planes. A cutout is contained in the pan of the housing at the end of the shaft. The cutout serves for mounting of an energy absorber, in particular a light absorber, extending into the shaft. An outwardly directed cooling element is mounted on the light absorber. In other words, when the printing apparatus is in the parked position, the radiation emergence side of the radiation source is located opposite a shaft having an integrated energy absorber that converts the irradiated energy, by multiple reflection at ribs arranged obliquely with respect to the radiation direction, into thermal energy, and discharges it via the cooling element to the outside air.

The cooling element is located outside the housing between the two supports of the printing machine, and protrudes out of the basally oriented pan arranged obliquely with respect to the horizontal plane.

The printing machine is furthermore equipped with a transport and pull-off device in order to guide the retaining apparatus or inscription carriers, with the uninscribed objects contained therein and located in the elevated input station, on the inclined printing plane to the printing position. The retaining apparatus or inscription carrier can also be stored as a stack in the input tray, from which it is conveyed via a pull-off device of the transport device which positions it, appropriately for inscription, in the printing position and then transports it into an output field, adjoining the lower part of the inclined printing plane, of the output station of the printing machine. In the output tray, the retaining apparatus or inscription carriers having the inscribed objects of a print job are stacked. In other words, the uninscribed objects arranged in the retaining apparatus or the inscription carrier are stackable in the input tray of the printing machine, on the higher portion of the printing planes arranged obliquely with respect to the horizontal installation planes; conveyed individually by a pull-off device to the transport device; and from this printing position, and after inscription, conveyed by the transport device into the output tray of the printing machine below the oblique printing plane, and there stacked. Transport of the retaining apparatus or of the inscription carriers in the printing machine occurs in a straight line from the supply stack in the input tray to discharge in the output tray.

Figure 3:
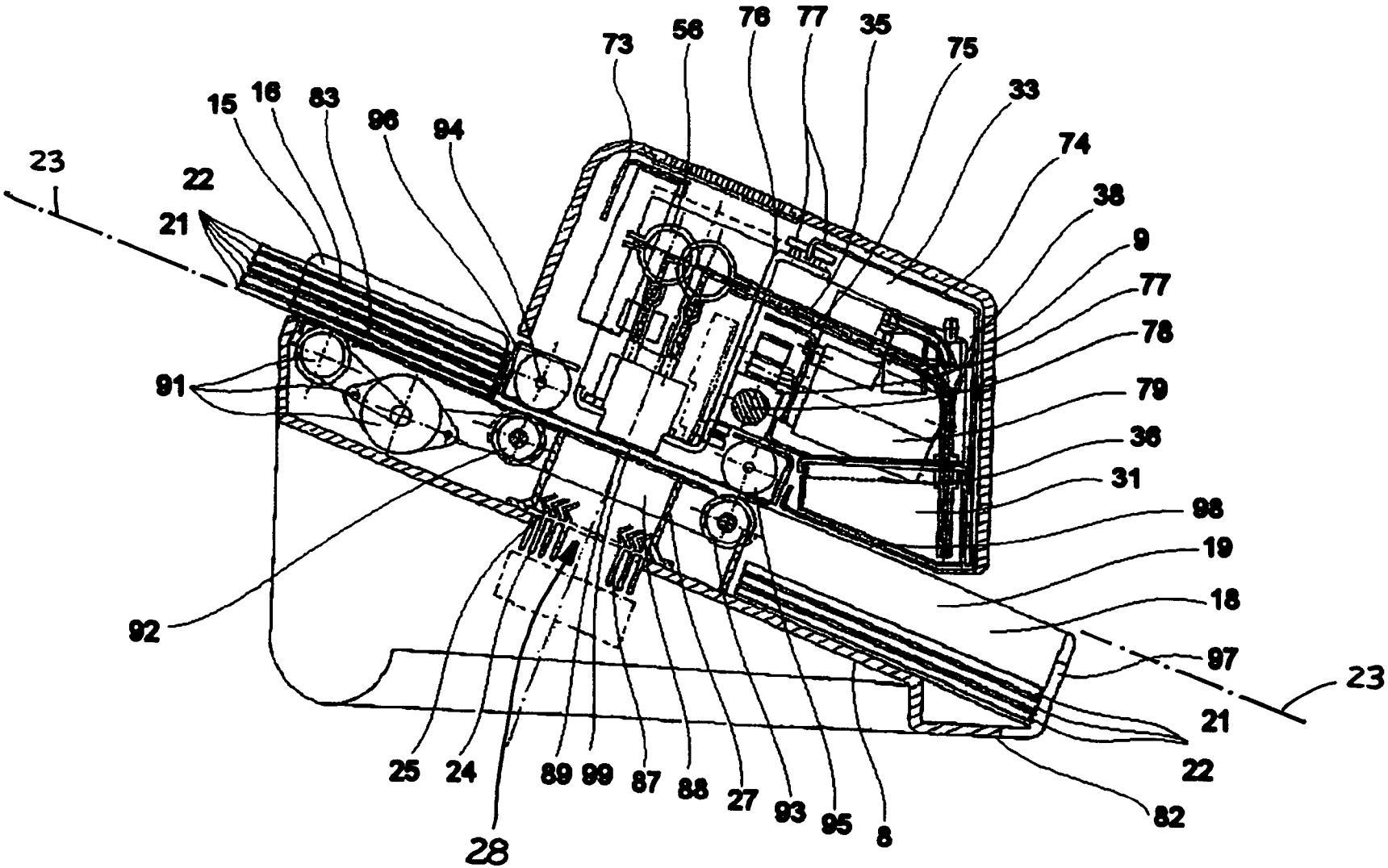
FIG. 3 is a cross section through the printing machine according to the present invention.
Figure 4:
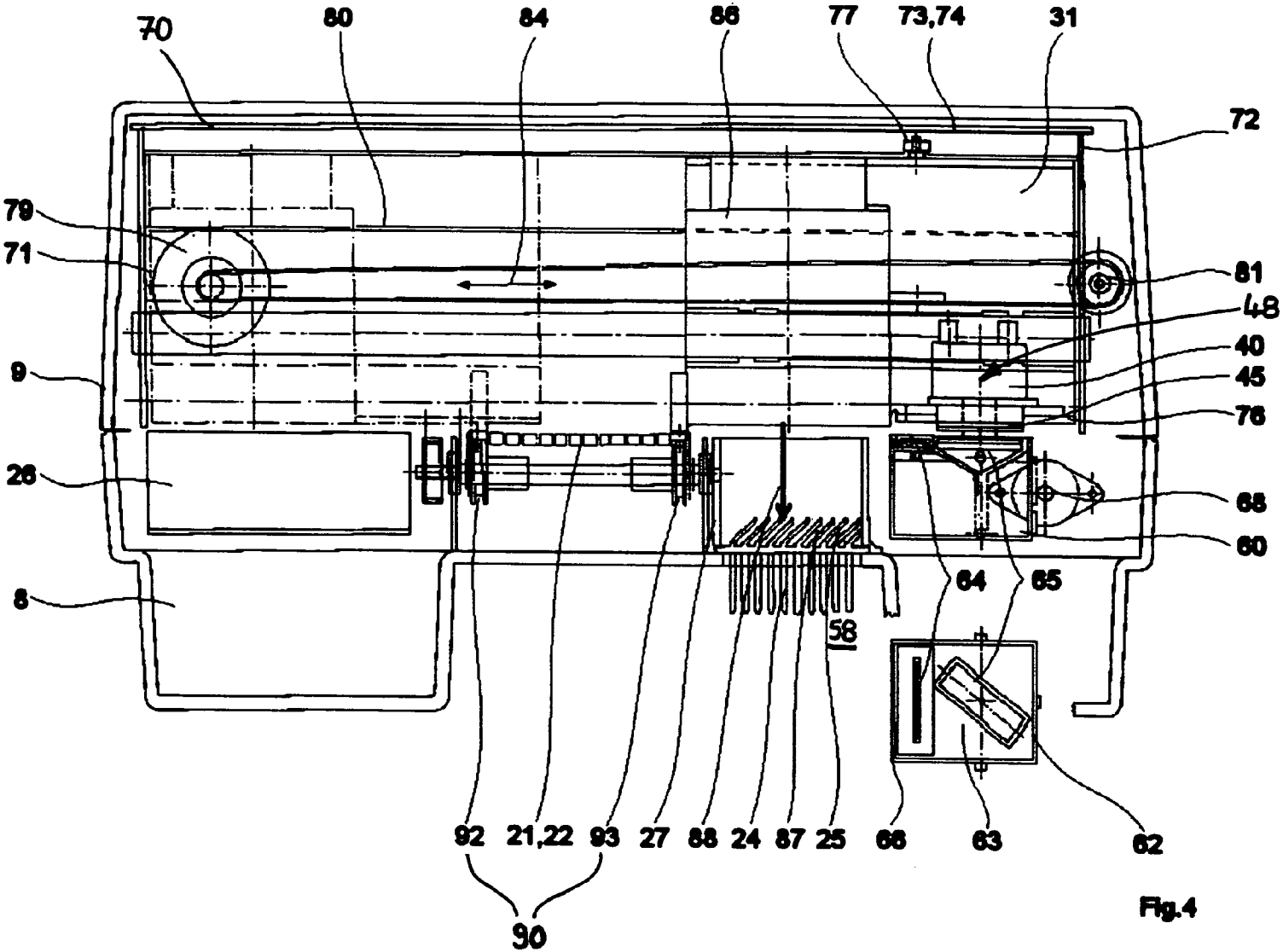
FIG. 4 is a longitudinal section through the printing machine according to the present invention.

The perspective view of FIG. 1 shows the apparatus according to the present invention, apparatus 1 preferably comprising a data processing system 2 embodied as a computer 3, and a printing machine 4, in particular an inkjet printer 5, whose device controller 26 is connected via a data line 6 and an interface to data processing system 2 and communicates therewith via said line. Inkjet printer 5 is encased in a housing 7. The housing encompasses a pan 8, a hood 9, and a cover 10, cover 10 containing the operating and indicating elements 11. Below pan 8, two supports 12 are arranged parallel to one another at a specific distance, and orthogonally to the carriage guide in printing machine 4. Supports 12 are embodied in a wedge shape, with the result that printing machine 4 assumes a tilted position perpendicular to the inscription direction. The tilt according to the present invention of printing machine 4 corresponds approximately to an angle from 20 degrees to 60 degrees, advantageously 40 degrees, and is achieved by the obliquity of wedge shape 13 of supports 12. Because of the advantageous inclination of printing machine 4, input station 15 for retaining apparatus 21 or inscription carriers 22 is located above, or elevated with respect to, output station 18, the two stations 15, 18 being connected to one another by a plane 23. As a result of the wedge-shaped supports 12, plane 23 corresponds to an inclined plane 23 on which retaining apparatus 21 or inscription carriers 22 are conveyed by a transport device (see FIG. 3) from input station 15 via printing and exposure station (see FIG. 3 and FIG. 4) to output station 18. For the reception of retaining apparatuses 21 or inscription carriers 22, input station 15 contains an input tray 16 in which apparatuses 21 and carriers 22 having the uninscribed objects 14 can be stacked. Input tray 16 is furthermore equipped with a displaceable side stop 17 by means of which different dimensions of apparatus 21 and carriers 22 are stackable in input tray 16. Output station 18 possesses, in output tray 19, an end stop 20 against which apparatus 21 and carrier 22 having the inscribed objects 14 come to rest. Output tray 19 is configured in such a way that, as in input tray 16, apparatuses 21 and carriers 22 can be stacked on inclined plane 23. A cooling element 24 that is visible in FIG. 3 and FIG. 4 is located below pan 8, arranged between the two supports 12.

Figure 2:
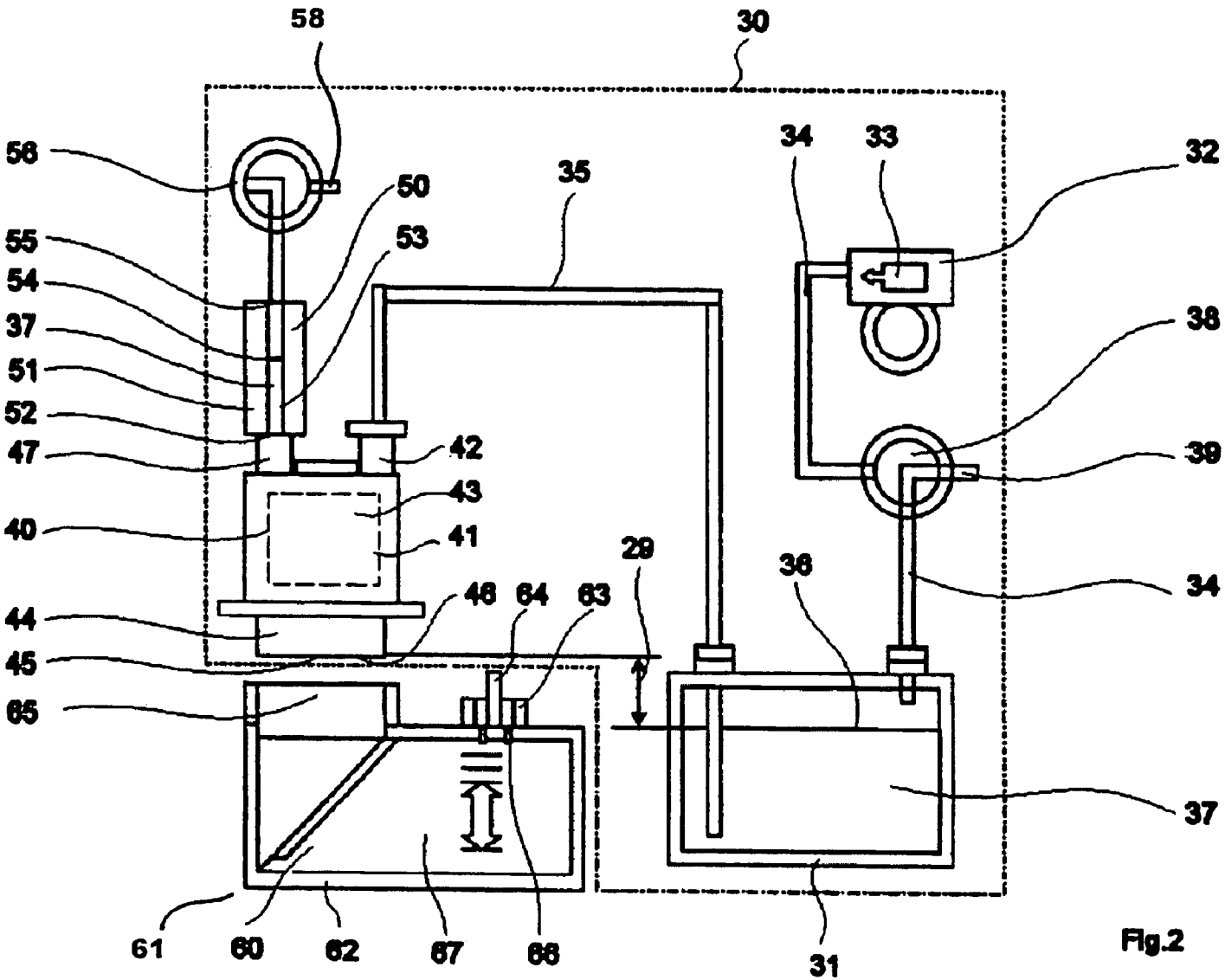
FIG. 2 schematically depicts, in section, a liquid supply unit having a cleaning device.

FIG. 2 is a schematic sectioned depiction of a liquid supply unit 30 according to the present invention having a cleaning apparatus 60, liquid supply unit 30 encompassing a method and an apparatus that are suitable for measuring a fill level 54 of a liquid 37, for controlling a device 32, for generating a positive pressure in a liquid container 31, and for discharging a liquid 37 for cleaning a nozzle device 45. Liquid supply unit 30 substantially comprises a replaceable liquid container 31 that is connected via a detachable valve 38 to a unit 32, in particular an air compressor 33, via a supply line 34, and connected to a detachable liquid line 35 for conveying liquid 37 out of liquid container 31 to a printing apparatus 40 that is constituted by a closed housing 41, an inflow opening 42, a reservoir 43, a print head 44 having nozzle device 45, and an outlet opening 47, such that a measuring apparatus 50, in particular a liquid level sensor 51, having an inlet opening 52 that opens into a chamber 53 for measuring liquid level 54, having an outlet opening 55, and having a valve 56 installed on outlet opening 55, is connected to outlet opening 47.

The function of liquid supply unit 30 in combination with cleaning apparatus 60 will be explained below with reference to typical functions.

In order to fill printing apparatus 40 with liquid 37, a positive pressure is generated with air compressor 33, via valve 38 that is open to air compressor 33, in the air space above liquid level 36 in liquid container 31. Liquid 37 is thereby pushed through liquid line 35 toward printing apparatus 40, with the result that reservoir 43 of printing apparatus 40 is flooded and then rises in outlet opening 47, in which context chamber 53 of liquid level sensor 51, connected via outlet opening 47, fills up. When a reference level is reached in sensor 51, the latter sends a signal to device controller 26, which shuts off air compressor 33 and closes valve 56 above liquid level sensor 51, and switches valve 38 between liquid container 31 and air compressor 33 over to external venting 39. The same atmospheric pressure is therefore always present on liquid level 36 in liquid container 31 and on nozzle device 45 of printing apparatus 40. Because of the capillary action of nozzles 46 in nozzle device 45, no liquid 37 drips out of the latter if liquid level 36 is lowered, or is located lower down, by an amount 29 (on the order of a few millimeters) with respect to nozzle device 45.

In the context of the cleaning operation, printing apparatus 40 is in parked position 48 directly opposite cleaning station 61, which latter substantially comprises cleaning apparatus 60, a replaceable cleaning container 62, a wiping device 63, and a drive unit 68; cleaning container 62 contains an opening 65 for the reception of liquid 37 occurring during the cleaning operation. In parked position 48, print head 44 with its nozzle device 45 is located directly opposite opening 65. Valve 56 above sensor 51 is closed, and valve 38 above liquid container 31, to air compressor 33, is open. Air compressor 33 generates in liquid container 31 a positive pressure that causes liquid 37 contained in reservoir 43 of printing apparatus 40 to emerge from nozzle 45 and drip into opening 65 of cleaning apparatus 60. Drive unit 68 then moves cleaning apparatus 60 toward print head 44. As a result of the linear stroke of cleaning apparatus 60, wiping device 63 is moved to the height of nozzle device 45, and as a result of the motion of carriage 76 in the linewise direction, print head 44 skims over wiper blade 64 contained in wiping device 63, and removes the liquid residues present on nozzle 46 or on the nozzles. The wiped-off liquid runs off, through small openings 66 that are arranged next to wiper blade 64, into storage space 67 of cleaning container 62.

FIG. 3 is a cross section through printing machine 4 according to the present invention in inclined form and with complete embodiment of an inkjet printer 5, and FIG. 4 depicts in longitudinal section an embodiment of printing machine 4.

Inkjet printer 5 comprises the elements of a printing machine housing 7, a printer frame 70, a carriage 76 having a drive unit 79, a liquid supply unit 30 made up of a printing apparatus 40, liquid container 31, liquid lever sensor 51, and an air compressor 33, a cleaning apparatus 60 made up of cleaning container 62, a wiping device 63, and a drive unit 68, a radiation source 86 having energy absorber 87 and cooling element 24, a transport device 90 and pull-off device 91 having transport rollers 92, 93 and idler rollers 94, 95, a retaining apparatus 21, and an inscription carrier 22.

Inkjet printer 5 contains a housing 7 having supports 12 arranged thereon in wedge shape 13 that produce the inclination of printing machine 4, as well as a printer frame 70 with which side walls 71, 72 of housing 7 are held at a distance by a crossmember 75 and angled crossmembers 73, 74. Also installed in housing 7 of inkjet printer 5 is a carriage 76 having a drive unit 79 that is mounted internally on crossmembers 73, 74, 75. Carriage 76 is guided parallel to printing-line direction 84 by carriage guide 77 having guide axis 78, and driven by drive unit 79 via a belt 80 that is deflected via a roller 81. In addition, a printing apparatus 40 and a liquid container 31 connected thereto via a liquid line 35 are arranged on carriage 76 mounted in housing 7. The two elements 40, 31 are guided at a short distance 98, 99 above printing plane 83, printing plane 83 being tilted with respect to horizontal plane 82 to the extent that the replaceable liquid container 31, with its liquid level 36, is in a lowered position with respect to nozzle device 45 of printing apparatus 44. Because of the tilt of printing plane 83 and of plane 23 over which objects 14 to be inscribed are guided and, in the context of printing, transported to output station 18, it is possible to position the replaceable liquid container 31 with its topmost housing edge below nozzles 46, and to arrange it at a short distance, in printing-line direction 84, from printing apparatus 44.

With non-tilted guidance of objects 14 to be inscribed, conversely, liquid container 31 can be arranged lower than the printing apparatus only if the distance on the bar between the ink tank and the printing apparatus corresponds at least to the width of objects 14 to be inscribed. In that case objects 14, viewed in printing-line direction 84, would be transported in the context of a printing operation between liquid container 31 and printing apparatus 44 to output station 18.

The inclined plane thus makes possible a particularly narrow configuration of the printer.

Liquid container 31, is connected, with further interposition of a valve 38, to an air compressor 33 that provides for the generation of positive pressure in liquid container 31. Installed at outlet opening 47 of printing apparatus 40 is a liquid level sensor 51 to whose exit 55 a valve 56 is connected. Located opposite nozzle device 45 arranged on print head 44, below the inclined printing plane 83, is a cleaning apparatus 60 made up of a cleaning container 62 for the reception of cleaning liquid 37, a wiping device 63 having a wiper blade 64 for removing liquid residues on nozzle device 45, and a drive unit 68 that raises and lowers cleaning apparatus 60 in a vertical direction with respect to nozzle device 45. Located next to printing device 40 on the common bar 76 in printing-line direction 84 is a radiation source 86 that illuminates objects 14 with a radiation after the printing operation, and dries and cures print patterns 85. To avoid unnecessary switching on and off of radiation source 86, radiation source 86 remains switched on during the operation of printer 4, 5 even when printing apparatus 40 is in parked position 48. With printing apparatus 40 in parked position 48, radiation source 86 is located opposite a shaft 27 that is arranged below printing plane 83. Mounted at the end of shaft 27, in a cutout 28 of the housing wall, is an energy absorber 87 at whose oblique ribs 25 the radiation is repeatedly reflected and converted into heat. Adjoining energy absorber 87 is a cooling element 24 for transporting heat away to the outside air; cooling element 24 protrudes, between the two supports, out of the basally oriented pan 8, arranged obliquely with respect to horizontal plane 82, of housing 7. Printing machine 4 is further equipped with a transport device 90 and pull-off device 91 for transporting objects 14 to be imprinted. Objects 14 to be imprinted can be arranged in a retaining apparatus 21 or in an inscription carrier 22; retaining apparatus 21 or inscription carrier 22 lie, individually or as supply stack 88, in input tray 16 of the elevated input station 15, and are braced against angled stop 96 so as not to slide down, since input station 15 is located on the elevated portion of the inclined printing plane 83. The respectively bottommost retaining apparatus 21 or bottommost inscription carrier is pulled out of supply stack 88 in input tray 16 by a pull-off device 91, and discharged to transport device 90 made up of a transport wheel 92 and an idler roller 94. Transport device 90 conveys retaining apparatus 21 or inscription carrier 22 in accurately positioned fashion into printing position 89 and, after inscription with print pattern 85, conveys it with transport wheel 93 and idler roller 95 into output tray 19 of output station 18 for discharge 89, discharge area 89 being suitable for stacking retaining apparatus 21 or inscription carriers 22. Output tray 19 is located on the low portion of inclined printing plane 83, retaining apparatus 21 or the inscription carrier being prevented by an angled stop 97 from sliding out of the output tray.

List of Reference Characters

1 Apparatus
2 Data processing system
3 Computer
4 Printing machine
5 Inkjet printer
6 Data line
7 Housing
8 Pan
9 Hood
10 Cover
11 Operating and indicating elements
12 Supports
13 Wedge (inclined plane)
14 Objects
15 Input station
16 Input tray
17 Side stop
18 Output station
19 Output tray
20 End stop
21 Retaining apparatus
22 Inscription carrier
23 Inclined plane
24 Cooling element

25 Cooling ribs
26 Device controller
27 Shaft
28 Cutout
29 Dimension
30 Liquid supply unit
31 Liquid container
32 Device
33 Air compressor
34 Supply line
35 Liquid line
36 Liquid level
37 Liquid
38 Valve
39 Outside air
40 Printing apparatus
41 Housing
42 Inflow opening
43 Reservoir
44 Print head
45 Nozzle device
46 Nozzle
47 Outlet opening
48 Parked position
49 unassigned
50 Measuring apparatus
51 Liquid level sensor
52 Inlet opening
53 Chamber
54 Liquid level
55 Outlet opening
56 Valve
57 unassigned
58 Outside air
59 unassigned
60 Cleaning apparatus
61 Cleaning station
62 Cleaning container
63 Wiping device
64 Wiper blade
65 Opening
66 Small opening
67 Storage space
68 Drive unit
69 unassigned
70 Printer frame
71 Left side wall
72 Right side wall
73 Angled crossmember
74 Angled crossmember
75 Crossmember
76 Carriage
77 Carriage guide
78 Guide axis
79 Drive unit
80 Belt
81 Roller
82 Horizontal plane
83 Printing plane
84 Printing-line direction
85 Print pattern
86 Radiation source
87 Energy absorber
88 Radiation direction
89 Printing position
90 Transport device
91 Pull-off device
92 Transport wheel I
93 Transport wheel II
94 Idler roller I
95 Idler roller II
96 Angled stop, upper
97 Angled stop, lower
98 Short distance from 31
99 Short distance from 40

The invention claimed is:

1. An apparatus for imprinting objects, comprising:

a printing machine including:

a transport apparatus configured to transport a retaining apparatus or an inscription carrier;

a printing apparatus configured to imprint a print pattern on at least one object using a jet of liquid;

a radiation source configured to dry and cure the print pattern;

a replaceable liquid container configured to supply the printing apparatus with a liquid;

a replaceable cleaning apparatus configured to clean a nozzle device of the printing apparatus;

an input station and an output station configured to receive the retaining apparatus or the inscription carrier;

a carriage configured to receive the printing apparatus, the radiation source, and the liquid container, the carriage being movable back and forth; and a data processing system configured to control the printing machine, wherein the printing apparatus and the liquid container are arranged with respect to each other so that the liquid container is lower than the nozzle device so that a liquid level of the liquid container produces a negative pressure in the nozzle device, and wherein the liquid container includes an entrance side and an exit side, wherein the entrance side is detachably connected via a valve to a positive pressure device and the exit side is detachably connected to the printing apparatus, wherein the positive pressure device is configured to produce a positive pressure in the liquid container.

2. The apparatus as recited in claim 1, wherein the at least one object includes at least one plastic part.

3. The apparatus as recited in claim 2, further comprising a housing of the printing machine configured so that the input station is disposed elevated relative to the output station, so as to provide an inclined plane between the input station and the output station so as to provide a printing plane.

4. An apparatus for imprinting objects, comprising:

a printing machine including:

a transport apparatus configured to transport a retaining apparatus or an inscription carrier;

a printing apparatus configured to imprint a print pattern on at least one object using a jet of liquid;

a radiation source configured to dry and cure the print pattern;

a replaceable liquid container configured to supply the printing apparatus with a liquid;

a replaceable cleaning apparatus configured to clean a nozzle device of the printing apparatus;

an input station and an output station configured to receive the retaining apparatus or the inscription carrier;

a carriage configured to receive the printing apparatus, the radiation source, and the liquid container, the carriage being movable back and forth;

a data processing system configured to control the printing machine; and a measuring apparatus including a measuring exit selectably openable and closeable using a valve, wherein the measuring apparatus is configured to connect to an outlet opening of the printing apparatus.

5. The apparatus as recited in claim 1, further comprising a cleaning apparatus including:

a replaceable cleaning container having an opening configured to receive the liquid;

a storage space for the liquid;

a wiping device; and, at least one opening adjacent to the wiping device.

6. The apparatus as recited in claim 1, wherein a radiation side of the radiation source is disposed opposite a shaft having an energy absorber when the printing apparatus is in a parked position, wherein the energy absorber is configured to convert irradiation energy into thermal energy using a plurality of reflections at ribs disposed obliquely relative to a radiation direction, and wherein the energy absorber is configured to discharge the thermal energy via a cooling element to outside air.

7. The apparatus as recited in claim 1, wherein the inscription carrier includes a plurality of inscription carriers stackable in an input tray on an elevated portion of a printing plane, individually deliverable to the transport device using a pull-off device, conveyable to a printing position for inscription, conveyable into an output tray of the output station using the transport apparatus, and stackable in the output tray, wherein the printing plane is disposed obliquely with respect to a horizontal installation plane.

8. The apparatus as recited in claim 1, wherein the retaining apparatus or the inscription carrier is stackable in an input tray of the input station and an output tray of the output station.

9. The apparatus as recited in claim 1, wherein the retaining apparatus or the inscription carrier are transportable in the printing machine in a straight line from a supply stack of an input tray of the input station to a discharge stack in an output tray of the output station.

10. The apparatus as recited in claim 1, further comprising:

at least two supports, the printing machine being configured to stand on the at least two supports, the at least two supports being disposed obliquely with respect to a horizontal plane of a housing;

a cooling element disposed between the at least two supports; and, a pan protruding from between the at least two supports.

* * * * *